US005302252A

United States Patent [19]

Götz

[11] Patent Number: 5,302,252

[45] Date of Patent: Apr. 12, 1994

[54] HEATED EXTENDED NIP PRESS WITH INLET SUPPORT POCKET

[75] Inventor: Thomas Götz, Hagnau, Fed. Rep. of Germany

[73] Assignee: Sulzer-Escher Wyss GmbH, Ravensburg, Fed. Rep. of Germany

[21] Appl. No.: 981,170

[22] Filed: Nov. 24, 1992

[30] Foreign Application Priority Data

Nov. 26, 1991 [DE] Fed. Rep. of Germany ..... 4138788

[51] Int. Cl.[5] ..... D21F 3/06

[52] U.S. Cl. ..... 162/358.5; 162/206; 162/358.3

[58] Field of Search ..... 162/358.3, 358.4, 358.5, 162/206

[56] References Cited

U.S. PATENT DOCUMENTS

| | | | |
|---|---|---|---|
| 4,614,565 | 9/1986 | Riihinen | 162/206 |
| 4,661,206 | 4/1987 | Heitmann et al. | 162/358.3 |
| 4,738,752 | 4/1988 | Busker et al. | 162/358.5 |
| 4,917,768 | 4/1990 | Ilmarinen | 162/358.3 |
| 4,948,466 | 8/1990 | Jaakkola | 162/206 |
| 4,973,384 | 11/1990 | Crouse et al. | 162/358.3 |
| 5,071,513 | 12/1991 | Bluhm . | |
| 5,110,417 | 5/1992 | Lehtonen | 162/358.3 |

FOREIGN PATENT DOCUMENTS

| | | |
|---|---|---|
| 0100895 | 2/1984 | European Pat. Off. . |
| 0258169 | 3/1988 | European Pat. Off. . |
| 0369968 | 11/1988 | European Pat. Off. . |
| 0400843 | 12/1990 | European Pat. Off. . |
| 3705241A1 | 7/1988 | Fed. Rep. of Germany . |
| 7329086 | 3/1974 | France . |
| WO91/00389 | 1/1991 | PCT Int'l Appl. . |
| WO91/08339 | 6/1991 | PCT Int'l Appl. . |

*Primary Examiner*—Karen M. Hastings
*Attorney, Agent, or Firm*—Townsend and Townsend Khourie and Crew

[57] ABSTRACT

An apparatus is provided for mechanical thermal dewatering of a web of fibrous material (1). The object is to provide a dewatering apparatus which delivers better drying results while precluding delamination of the web (1) of fibrous material. This is achieved in an apparatus in which the web of fibrous material is passed through at least two press surfaces (2, 3) which form a press gap and which exert the dewatering pressure on the web of fibrous material by forming one press surface (2) as an impermeable band (4) which can be pressed towards the other press surface (3) via a hydraulic pressing element means (15). A support pocket (5) is located in the pressing element essentially in the region between the web inlet end and the center of the pressing element means (15) and is effective to generate a hydrodynamic pressure field at the pressing element means (15) by setting a lubricant into circulation. The hydrodynamic pressure field provides the desired pressure characteristic as the web of paper material passes through the press zone.

14 Claims, 10 Drawing Sheets

HEATED EXTENDED NIP PRESS WITH INLET SUPPORT POCKET

FIELD OF THE INVENTION

The invention relates to an apparatus for the mechanical-thermal dewatering of a web of fibrous material and has particular reference to an apparatus of this kind comprising at least two press surfaces which form a press gap and which exert a dewatering pressure on the web of fibrous material, wherein at least one of said press surfaces is heatable and at least one of said press surfaces is formed by an impermeable band which can be pressed towards the other press surface via pressing element means arranged at the press zone and having at least one support pocket which is open towards the impermeable band and can be acted on by a pressure medium, and wherein the web of fibrous material is fed through the press gap together with a porous band suitable for taking up the pressed-out water.

BACKGROUND TO THE INVENTION AND PRIOR ART

It is known that the dewatering of a fiber material web can be increased if heat is used in addition to mechanical pressing. Thus a pressing section is known from U.S. Pat. No. 4,163,688 in which a steam blower box is arranged in the vicinity of a suction roller. The web of fibrous material can be heated sufficiently with the aid of steam that the dewatering performance of the subsequent pressing zone is increased.

While exploiting this effect the fiber material webs are often pressed against a heated drying roll via a felt band. The water vapor which thereby arises at the roll moves away from the roll surface and tears away in the direction of the felt band the water which is present in the fibrous web. During this the problem however arises that the steam pressure, which depends on the contact pressure and on the roll temperature, on the one hand promotes dewatering but, on the other hand, can lead to delamination of the fiber material web. Delamination is the description for the breaking up of the fiber material web after leaving the press gap as a result of the sudden pressure relief.

The method described in German Offenlegungsschrift 37 05 241 or in the U.S. equivalent U.S. Pat. No. 5,071,513, and also the associated apparatus, aims at providing a solution to the above problem of delamination in that the dewatering is effected in an extended pressure zone in which the web can be acted on in sections in the direction of through movement with differentially high pressures and temperatures. This is achieved essentially by several hydrostatic pressing elements which are arranged in series in the direction of through movement and are independently controllable.

As explained in U.S. Pat. No. 5,071,513, the full content of which is incorporated in the present application by way of reference, the pressure and temperature conditions in the first section as viewed in the travel direction of the fibrous web, can be selected such that the hydraulic pressure prevailing in the first section is higher than the equilibrium vapor pressure of the water contained in the fibrous web under the prevailing temperature conditions. A first portion of water is, then, merely squeezed out of the fibrous web into the porous band. In the following second section of the extended pressing zone, the pressure and temperature conditions are selected or adjusted such that the hydraulic pressure is higher than ambient pressure but lower than the equilibrium vapor pressure of water under the temperature conditions prevailing in the second section. Under these conditions, water vapor or steam is formed where the counter-roll contacts the fibrous web and such water vapor or steam formation is sufficient to expel or displace substantially the remaining or second portion of liquid from the fibrous web. In this manner, the fibrous web is relieved from the hydraulic pressure in the second section of the extended pressing zone so that the fibrous web can expand to a certain extent and does not exit from the extended pressing zone in a undesirable over-compressed state. Furthermore, the pressure and temperature conditions in the second section of the extended pressing zone can be selected or adjusted such that also at least part of the water which adheres to the fibers of the fibrous web is also evaporated and displaced or transported into the porous band if the temperature in the fibrous web is sufficiently high and condensation of the water vapor or steam within the fibrous web can be avoided. This beneficial effect is further enhanced when the fibrous web exits from the extended pressing zone and the pressure is further reduced to ambient pressure.

During passage through the extended pressing zone, the counter-roll transfers or looses heat to the through-passing fibrous web and other components of the dewatering apparatus. Under certain conditions, the heat loss may assume such extent that the temperatures are insufficient for the desired evaporation in the second section of the extended pressing zone.

A similar solution to that set forth in DE OS 37 05 241 is proposed in the later published International Application WO 91/00389 in which two hydrostatic pockets are provided in series in the press zone in a shoe member. Although this reference also recognizes that it is important for the pressure profile in the press gap to be controlled so as to avoid delamination, the arrangement proposed is mechanically relatively complex.

In addition to the added complexity and expense for the pressing elements of U.S. Pat. No. 5,071,513, the fact that the pressure can only be changed sectionally is also to be regarded as a disadvantage.

OBJECTS OF THE PRESENT INVENTION

The principal object of the present invention is to provide an apparatus for the mechanical-thermal dewatering of a web of fibrous materials which provides better drying results while precluding the delamination of the fiber material web and thereby precludes the named disadvantages.

It is a further object of the present invention to provide a mechanically relatively simple and economically realizable apparatus for the dewatering of a web of fibrous materials.

BRIEF DESCRIPTION OF THE INVENTION

In accordance with the invention, the above objects are satisfied by an apparatus of the initially named kind which is characterized in that the support pocket is located essentially in the region between the web inlet end and the center of the pressing element means, and in that a hydrodynamic pressure field is active between the pressing element means and the impermeable band by setting a lubricant in circulation.

Through the special layout of the pressing element means a pressure characteristic arises in the press gap which is characterized by a rapid pressure rise at the web inlet, a constant pressure in the region of the support pocket and also a gradual pressure drop-off in the web outlet. Since the contact pressure directly affects the thermal transfer coefficient, and thus the quantity of heat transferred. This also signifies that the steam pressure prevailing in the fiber material web can relax in the web outlet through the reduced or hindered heat flow to the fiber material web and thus that delamination is prevented.

It is particularly advantageous to extend the press zone through the provision of a low pressure zone which adjoins the main press zone in the direction of through movement and thus to obtain a substantially longer time for the lowering of the steam pressure. The permeable flexible band used for this purpose surrounds the preferably heated counter roll, with the wrapping region and also the contact pressure being variable. The permeable flexible band moreover protects the porous band from the high temperature and increases, if cooled, the temperature gradients in the press zone which leads to increased condensation of the water vapor. The prior heating of the fiber material web likewise has a positive effect on the dewatering performance, because of the associated reduction of viscosity.

It is also beneficial to restrict the heated region of the counter roll to the outer layer since this signifies a reduction of the heat storage capacity. Associated with this is a restriction of the quantity of heat transferred into the fiber material web, with the simultaneous guarantee of the high temperature necessary for rapid heat transfer.

DESCRIPTION OF THE PREFERRED EMBODIMENTS

Figure 1:
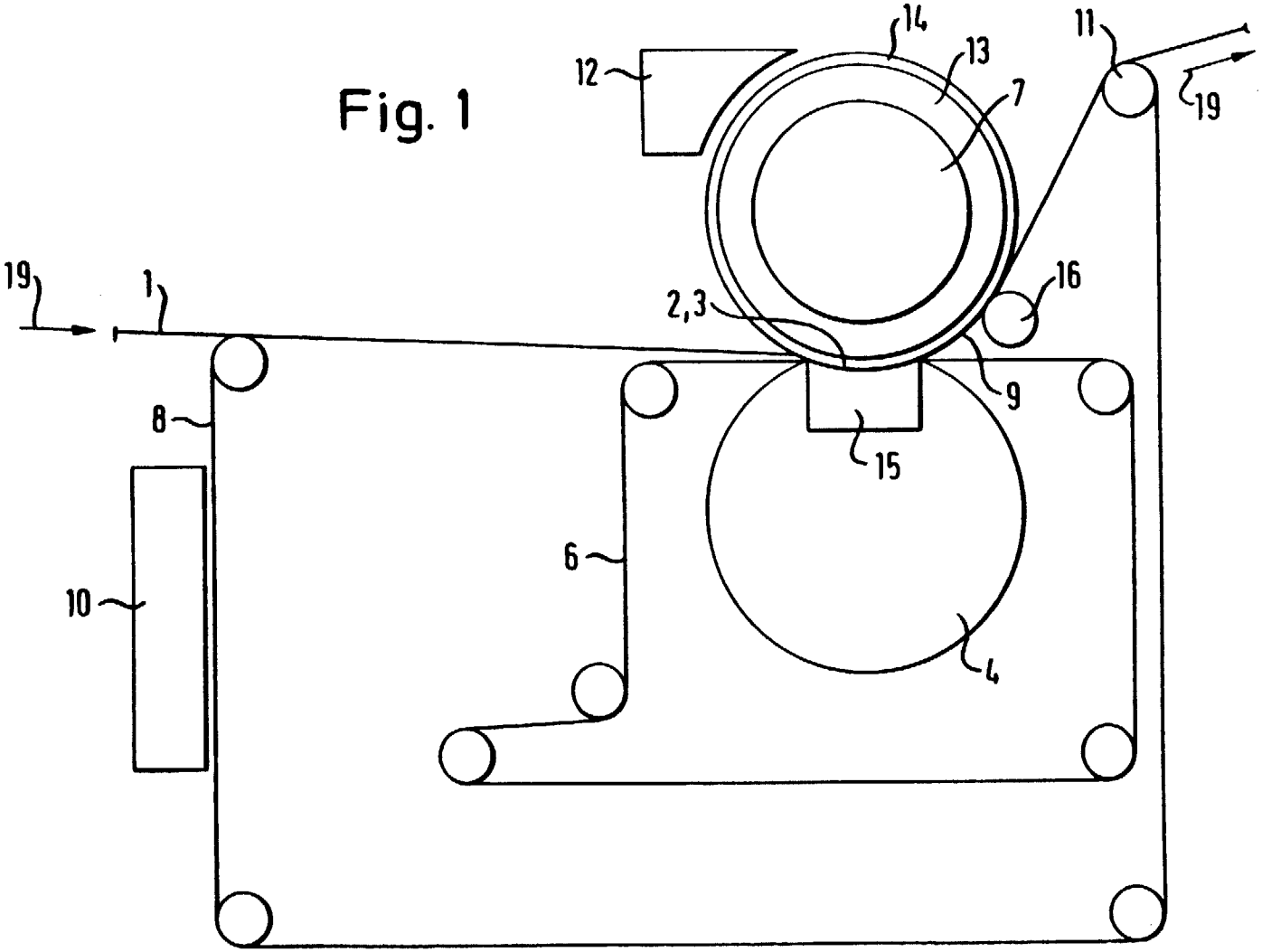
FIG. 1 shows a schematic side view of the dewatering apparatus.

As can be seen from FIG. 1, the press gap is formed by a heated counter roll 7, and also an impermeable, flexible and optionally metallic band 4 which can be pressed via pressing elements 15 arranged along the press zone, i.e. perpendicular to the plane of the drawing in FIG. 1, towards the other press surface 3. The web 1 of fibrous material, for example in the form of a paper web, is guided through the press gap together with a porous band 6 (for example of felt) suitable for taking up the pressed-out water. The pressing element 15 has a hydrostatic support pocket 5 which can be acted on by a pressure medium, such as for example oil, with the hydrostatic support pocket 5 being located essentially in the region between the web inlet side and the middle of the press element 15. Through the further setting into circulation of a lubricant which occurs and the associated build-up of a hydrodynamic pressure field at the pressure element 15, a pressure characteristic or variation arises in the press gap, as will also subsequently be described in connection with FIG. 2. Because of the gradual drop-off of the pressure in the web outlet the vapor pressure which prevails in the web of fibrous material can relax and thus delamination is counter-acted. It has proved to be of particular advantage when the area of the hydrostatic support pocket amounts to approximately 10–18% of the pressure active total area of the pressing element and when the center point of the support pocket as seen contrary to the direction of through movement of the fiber web is displaced from the middle point of the pressing element towards the web inlet end by about 21–32% of the pressure active total length of the pressing element.

In order to supplement these measures the press zone can be enlarged, as shown in FIG. 1, by a low pressure zone which adjoins it in the direction of through movement. This low pressure zone extends the time for the vapor pressure relaxation and is essentially formed by a permeable flexible band 8 which is arranged between the web of fibrous material 1 and the porous band 6 and which presses the web of fibrous material against the counter roller 7 over a wrapping region 9. A metallic fabric of the quality KPZ 55 of the company Villforth is, for example, suitable for the band 8. It is moreover of advantage when the extent of the wrapping region 9 and also the contact pressure exerted by the permeable band 8 (via the band tension) are variable with the aid of an adjustable roller 11 and thus possibilities are provided for adaptation to different fibrous materials and also their types of treatment. If, furthermore, the permeable band 8 is cooled via an apparatus 10, for example on the basis of a fan, then the temperature gradient in the press zone increases which promotes the condensation of the water vapor.

In order to be able to better regulate the temperature of the counter roll 7, and thus also the vapor pressure in the press zone, the counter roll 7 should be heated from the outside and the heated region should be restricted to the outer layer 14. When using an infra-red heating device 12 this has the consequence that the outer layer 14 consists of a thermally conductive material and surrounds an insulating layer 13. On using an inductive heating device 12 essentially only the outer layer 13 should consist of a ferro-magnetic material, in order to restrict the heating to this layer.

Figure 2:
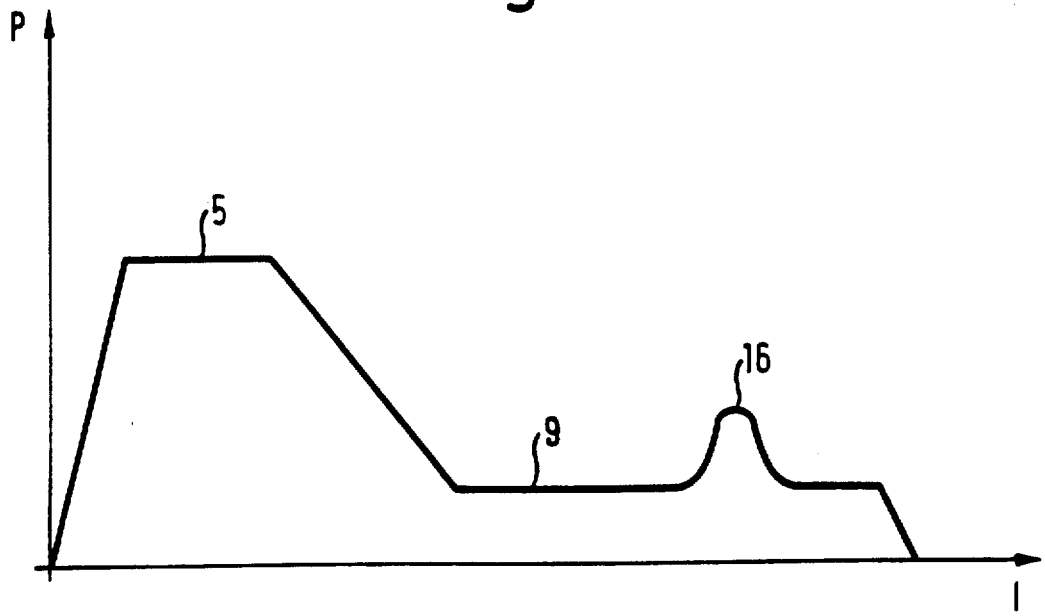
FIG. 2 shows the pressure characteristic in the pressure zone including its extension.
Figure 3:
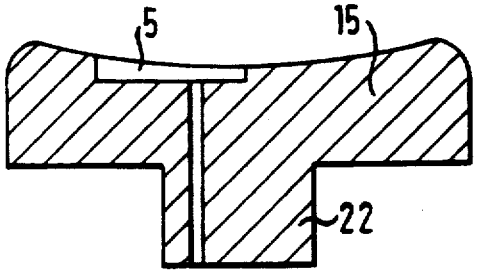
FIG. 3 shows a schematic illustration of the contact pressure element.

When using a pressure roll 16 which presses the permeable band 8 against the counter roll 7 in the region of the wrapping 9, and which offers additional variation possibilities, the pressure characteristic shown in FIG. 2 arises for the total press zone.

It is also entirely possible for the press gap to be formed by two impermeable bands 14 which are pressed against one another via hydraulic press elements 15. The specific layout of the dewatering device would then take place in analogous manner.

Figure 4:
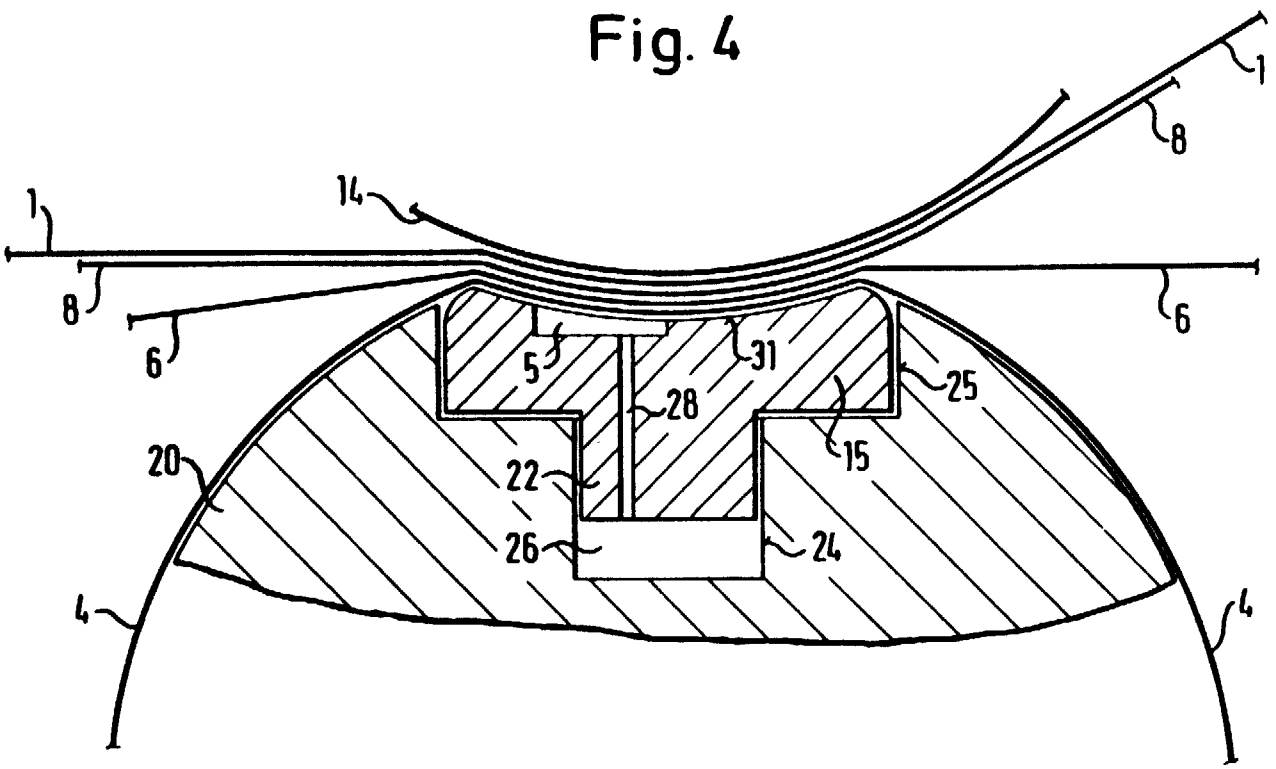
FIG. 4 shows a more detailed drawing of the arrangement of FIG. 1 in the region of the press gap.

Turning now to FIG. 4 there can be seen a more detailed drawing of the arrangement of FIG. 1, in particular in the vicinity of the press gap. The same reference numerals have been used in FIG. 4 as in the previous embodiments to denote the individual items such as the recirculating impermeable band 4, the water absorbing felt 6, the permeable band 8 and the fibrous web 1. The reference numeral 14 shows a portion of the periphery of the counter roll 13 and the reference number 15 designates now, as previously, the pressing element. In addition, the drawing of FIG. 4 shows part of a generally circular guide 20 which supports the circulating flexible impermeable band 4. Moreover, the drawing of FIG. 4 also schematically illustrates the manner in which the pressing element 15 is mounted, with its base portion 22 of rectangular cross-section disposed in a trough 24 of corresponding rectangular cross-section. Means (not shown) are provided for supplying pressurized fluid to the space 26 between the base of the portion 22 and the base of the trough 24. Pressure fluid supplied to the space 26 passes via the bore 28 into the channel 30 of the pressing element 15 and generates there immediately underneath the recirculating band 4 a hydrostatic pressure. In addition, fluid escapes through the narrow space 31 between the top-surface of the pressing element 15 and the continuously recirculating impermeable band 4, thus generating a progressively reducing hydrodynamic pressure in the gap 31. The fluid passing along the gap is collected and returned to the space 26. Precisely how this is done is not shown in FIG. 4 but will be described later with respect to two alternative embodiments. The pressure prevailing in the space 26 presses the pressing element as a whole towards the counter-roller and can be made higher than the pressure active on the upper surface of the pressing element 15 by the pressure drop which arises in the passage(s) 28.

Figure 5:
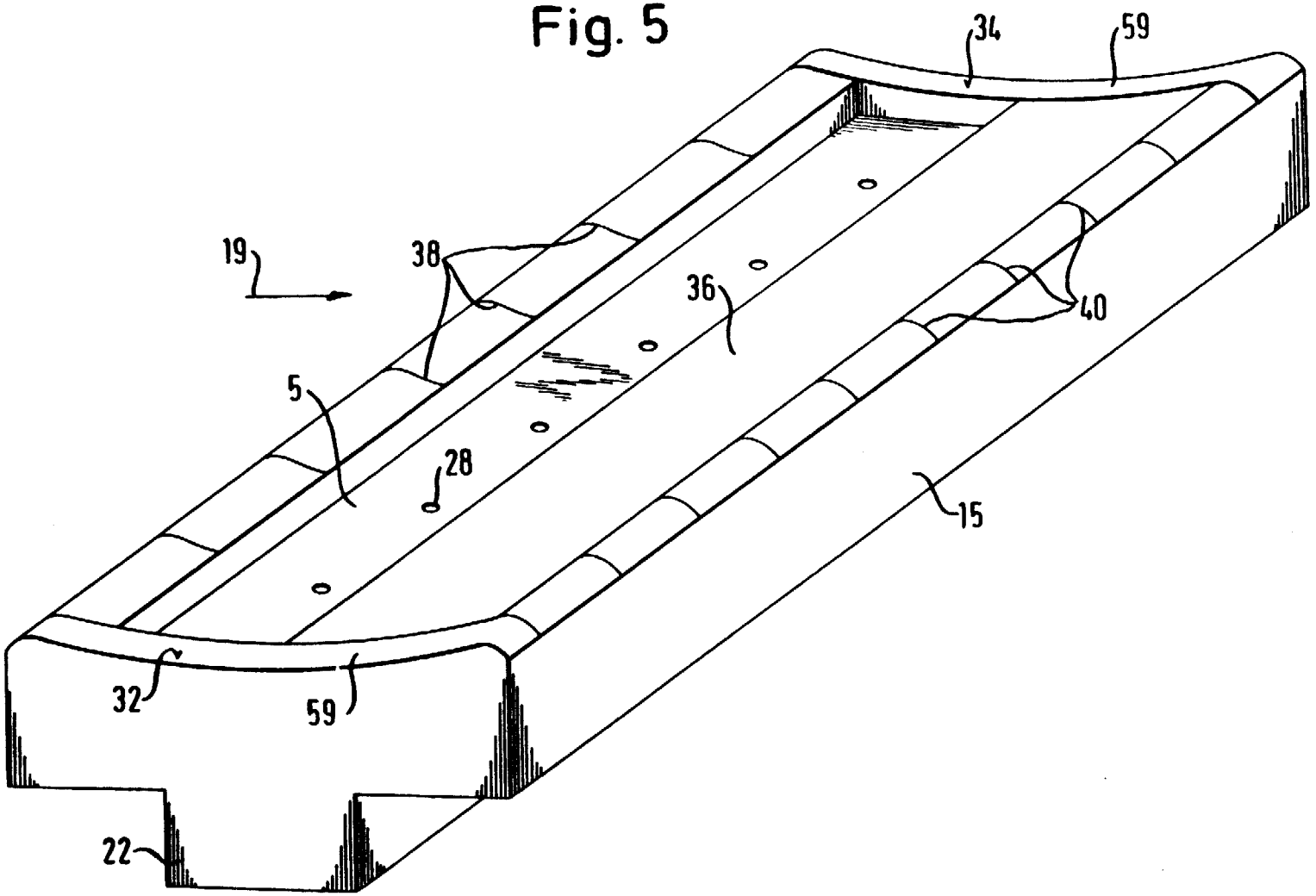
FIG. 5 shows a perspective view of one possible embodiment of a single pressing element used over the entire width of the pressing zone, i.e. transverse to the direction of movement of the fibrous web 1.

Various possibilities exist for the design of the pressing element 15. FIG. 5 shows an embodiment which could for example be used in the embodiment of FIGS. 1 to 4. Here the pressing element 15 extends over the full width of the press gap, i.e. as measured transverse to the direction of movement of the recirculating impermeable band 4. It can be seen that the rectangular pressure trough 5 also extends over substantially the full working width of the pressing element and thus of the band 4, the pressure trough 5 simply being bounded at its extreme right- and left-hand sides 32 and 34 by wall portions of the pressing element 15 which generally follow the contour of the impermeable band 4 and thus of the counter roller 14 in the press gap. Downstream of the pressure trough 5 to which pressure is applied is a surface 36 along which a pressure fluid is drawn hydrodynamically by the movement of the flexible impermeable band 4, and/or under the action of the pressure prevailing in the longitudinal trough 5, so that a hydrodynamic pressure is present in the region 36 which progressively reduces towards the outlet end of the pressing element 15, i.e. towards the right-hand end in FIG. 5.

The rectangular projection 22 of the pressing element 15 lies, as in the embodiment of FIG. 4, in a rectangular recess and is sealed relative to the walls of the rectangular recess so that pressure fluid applied to a space, such as 26 in FIG. 4, can pass upwardly through the drilled passages 28 into the longitudinal trough 5 prior to being directed over the surface 36 and generating the progressively reducing hydrodynamic pressure in the direction of movement 19 of the band. The lines 38 and 40 simply show that the pressing element 15 has rounded shoulders.

Figure 6:
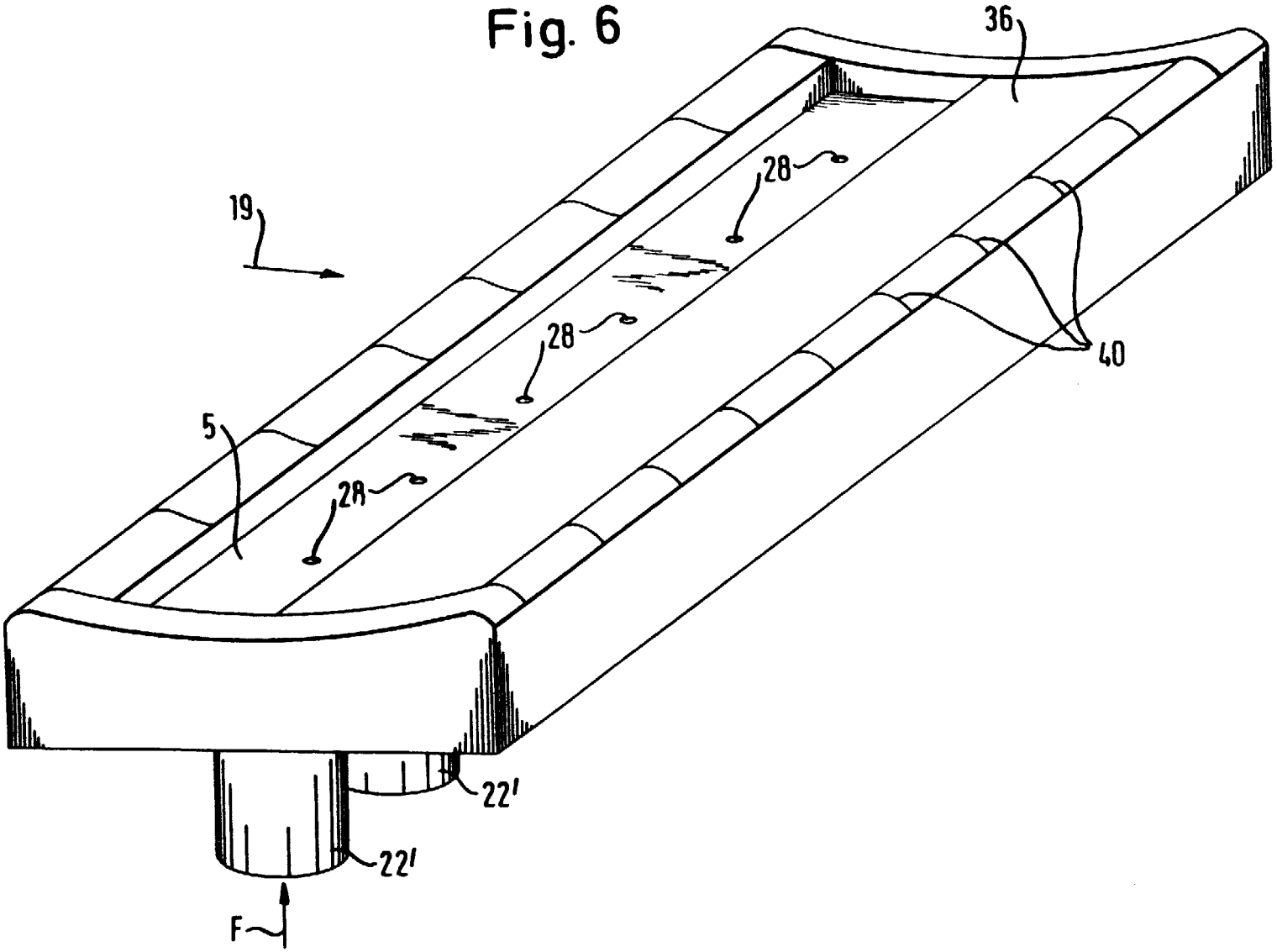
FIG. 6 shows a slightly modified variant of the embodiment of FIG. 5.

FIG. 6 shows an embodiment closely similar to that of FIG. 5, which explains why the same reference numerals have been used to discuss parts of the drawing of FIG. 6 which have counterparts in the drawing of FIG. 5. The difference between the two embodiments lies only in the fact that the rectangular beam 26 of FIG. 5 has been replaced in the drawing of FIG. 6 by a plurality of cylindrical posts 22' which fit into corresponding bores (not shown) of the base body (not shown in FIG. 6) which supports the pressing member. The advantage of such cylindrical projections 22' is that they can readily be sealed with an O-ring or lip seal so as to withstand considerable hydraulic pressure applied to their bases as illustrated by the arrow F in FIG. 6.

It should be noted that the pressing element 15 of FIG. 6 has been shown with a certain amount of artistic license in that its width (i.e. its dimension transverse to the direction of web movement) has been shortened relative to its length. This also applies to the illustrations of FIGS. 5, 7, 8 and 9. Moreover, the small openings 28 in FIGS. 5 and 6 and the trough 5 show the manner in which the hydraulic fluid is transferred from beneath the bases of the projections 22 into the hydrostatic channel 5 of the pressing element.

Figure 7:
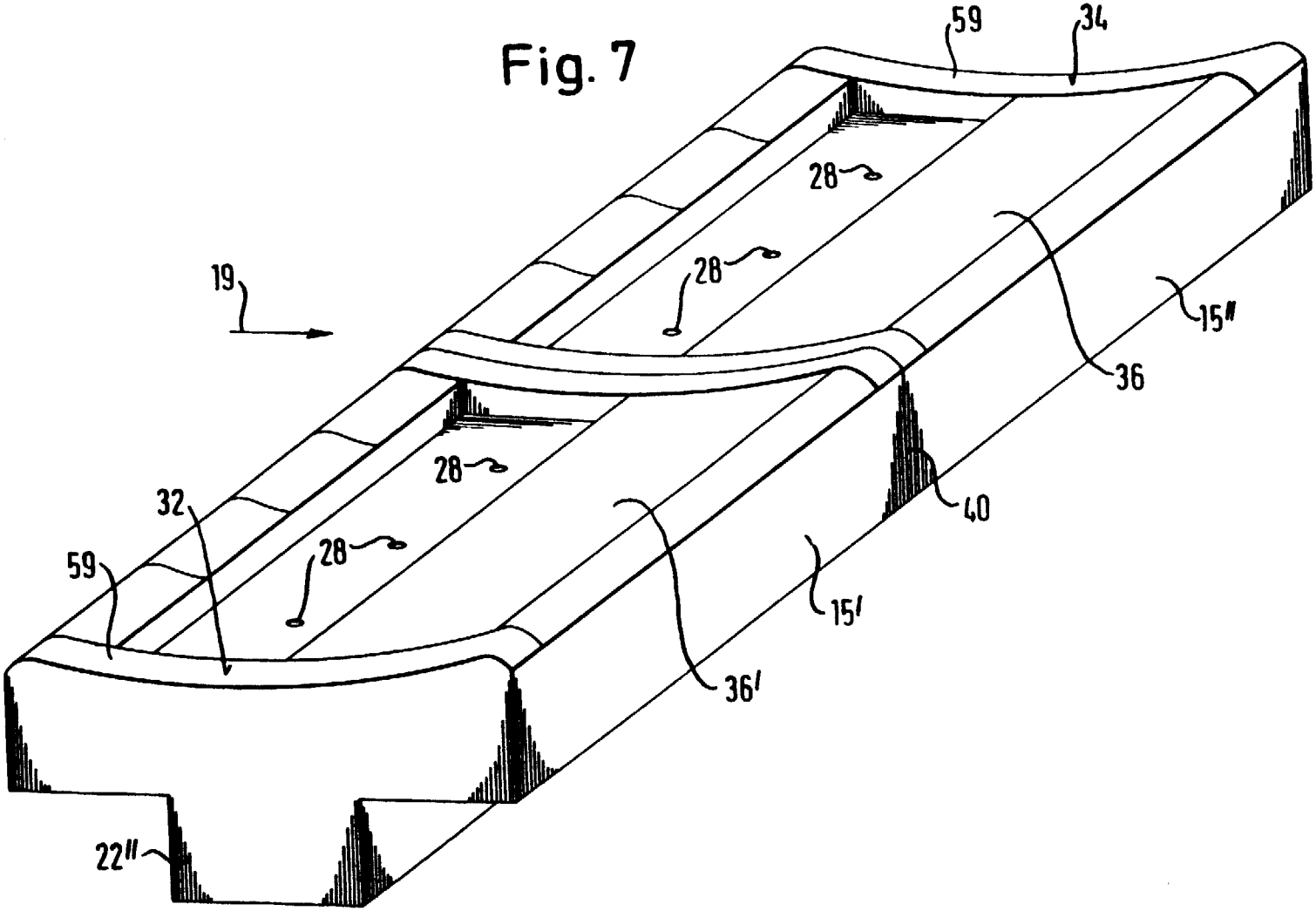
FIG. 7 shows an alternative embodiment similar to FIG. 5 but with two individual pressing elements arranged over the width of the press zone.

FIG. 7 shows an embodiment basically similar to that of FIG. 5 but here the pressing element has been subdivided into two pressing elements 15' and 15'' which are therefore of reduced length as seen in the transverse direction relative to the direction of movement of the flexible band 4. This means that the length/width ratio of the individual pressing elements 15 has increased substantially corresponding to that of FIG. 5. One notes that in this embodiment the pressing element 15 has been subdivided into two pressing elements 15' and 15'' which directly adjoin one another at a partition line 40. In practice, a plurality of pressing elements can be arranged alongside one another similar to the arrangement shown in FIG. 7 for just two such pressing elements.

Figure 8:
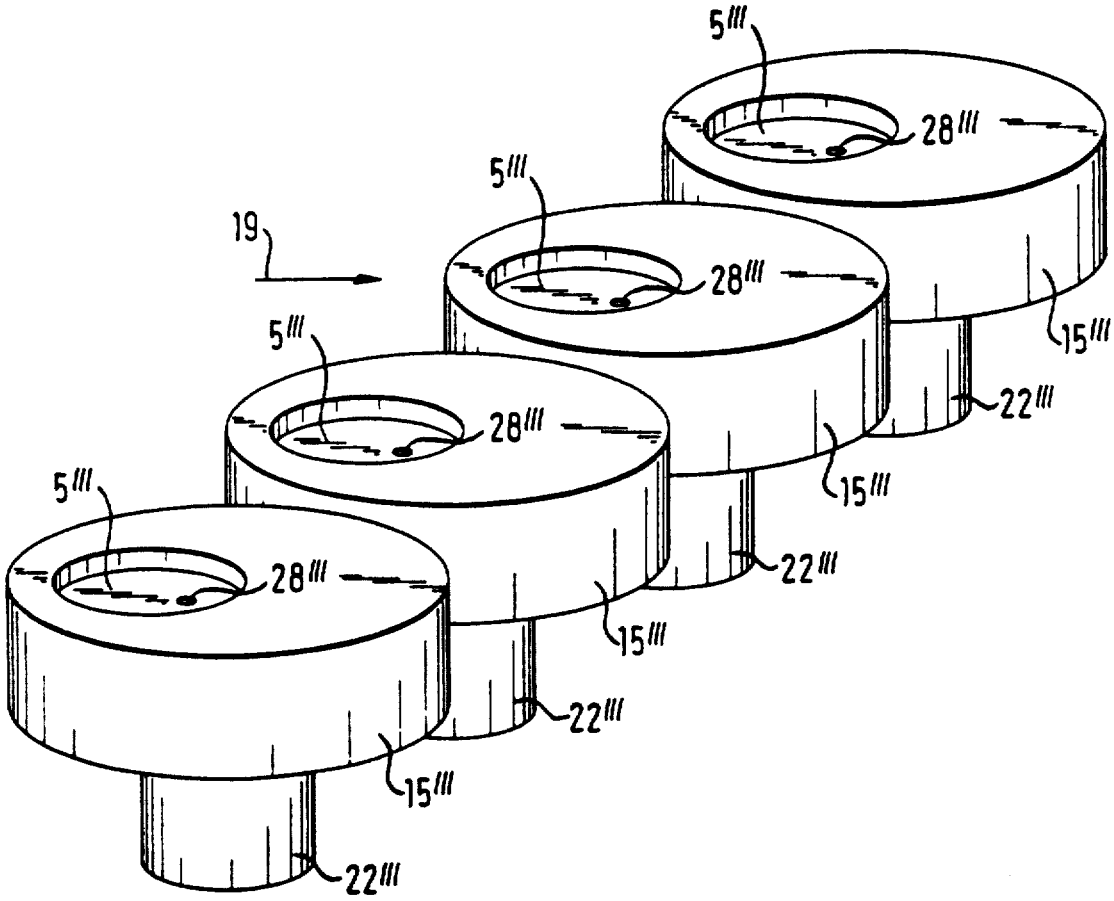
FIG. 8 shows a further alternative embodiment using a plurality of pressing elements arranged over the width of the pressing zone, the pressing elements being of circular cross-section.

FIG. 8 shows a further alternative embodiment to those of FIGS. 5, 6 and 7, in which pressing elements of rectangular cross-section are disposed along the width of the press gap. In the embodiment of FIG. 8, each of the pressing elements 15''' is of circular cross-section, at least as seen in plan view, and is supplemented by a cylindrical piston part 22''' resembling the pistons 22 of the embodiment of FIG. 6. Although not shown, it will be appreciated that each of the piston parts 22''' of the pressing elements 15''' of FIG. 8 is arranged in practice in a bore corresponding to that shown by the reference numeral 24 in FIG. 4. The pressing elements 15''' themselves are in practice arranged in circular recesses in a support member 20, such as the recesses labelled 25 in FIG. 4, and thus resemble in cross-section the arrangement shown in FIG. 4 of the accompanying drawings.

Figure 9:
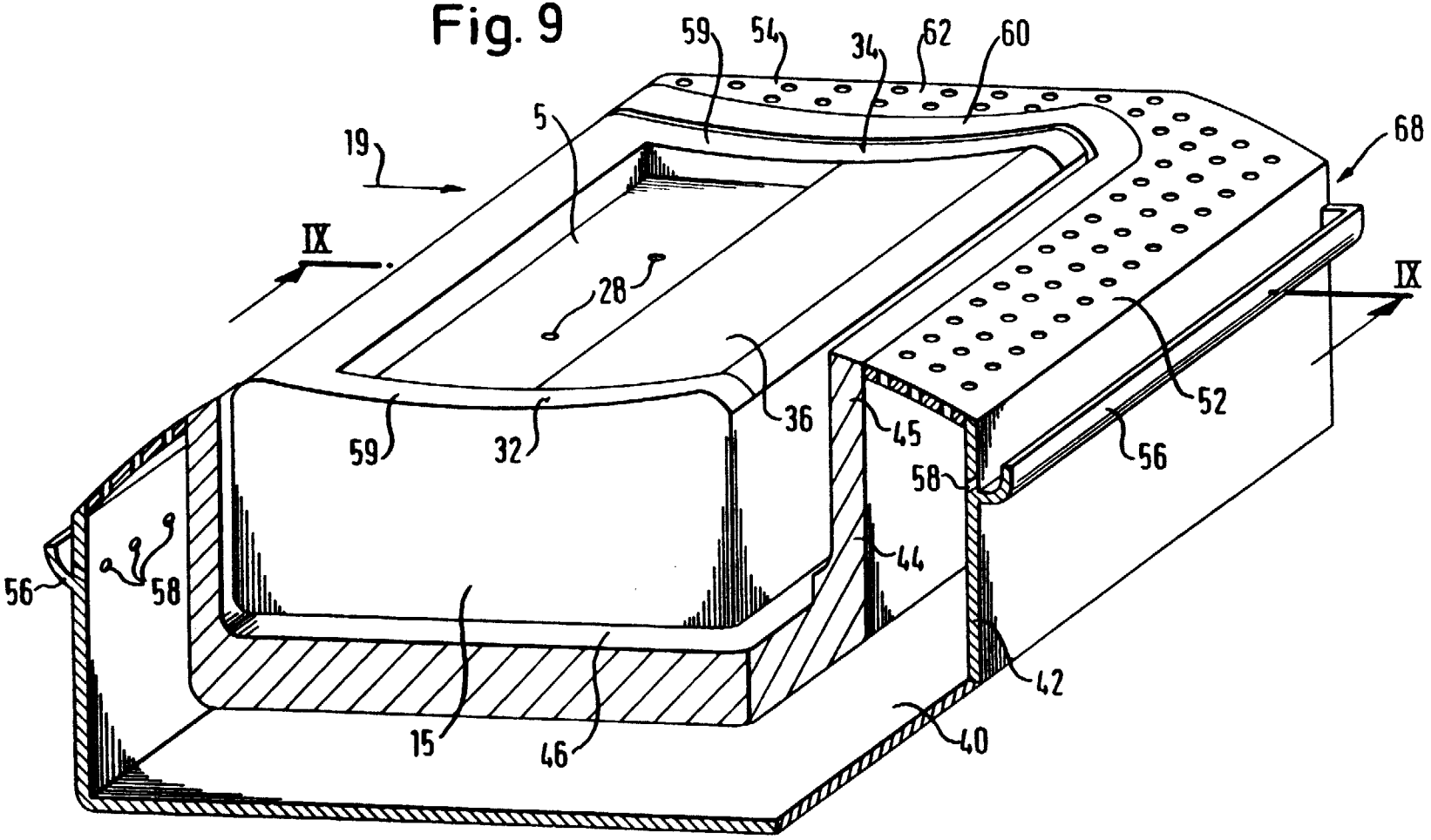
FIG. 9 shows a schematic perspective illustration of a possible practical embodiment of the invention.
Figure 10:
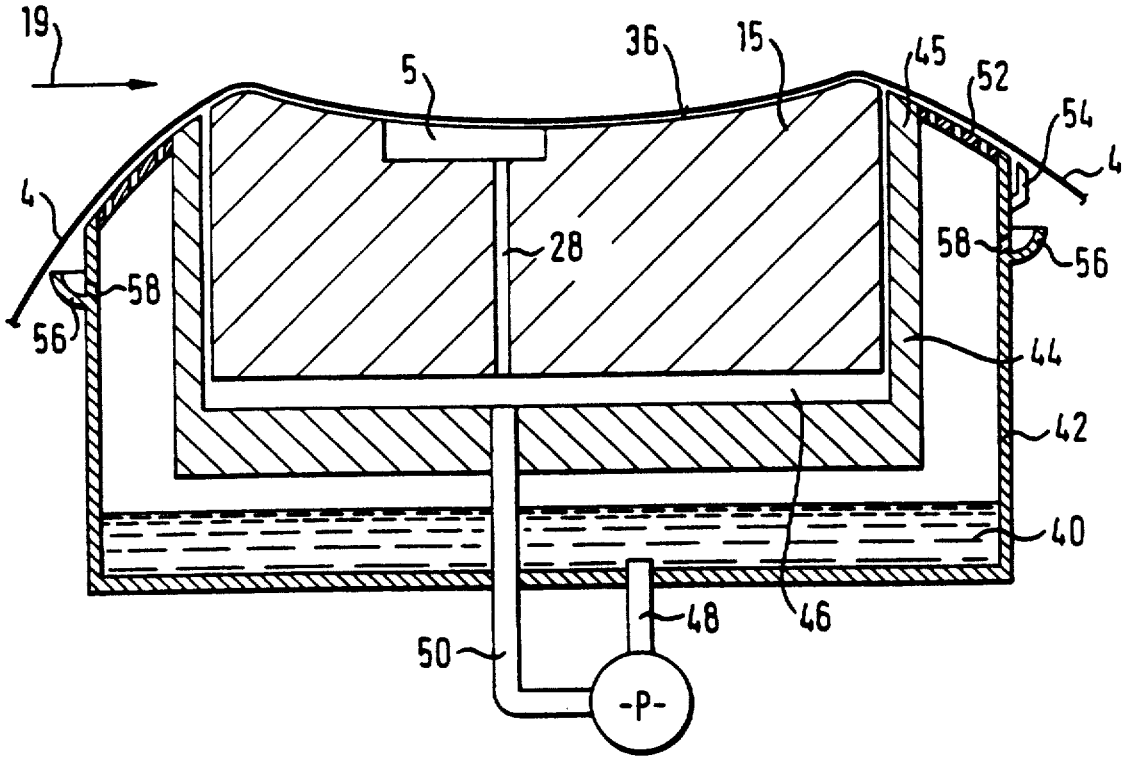
FIG. 10 shows a vertical cross-section through the arrangement of FIG. 9.

FIGS. 9 and 10 show an alternative preferred first embodiment of the pressing member 15 of the present invention. Here, the pressing element 15 shown for the purposes of the present discussion is a single pressing element which extends over the full width of the paper web in the press gap. As can be seen particularly from FIG. 10, a pump P draws hydraulic fluid from a reservoir or sump 40 within a rectangular chamber or housing 42. Disposed within the rectangular housing 42 is a rectangular housing part 44 which is spaced from the walls of the rectangular chamber 42 so as to define the sump 40. The base of the rectangular housing part 44 cooperates with the base of the pressing elements 15 to define a pressure fluid cavity 46 between itself and the pressing element 15. In operation the pump P draws hydraulic fluid from the sump 40 via the inlet-line 48 and delivers this fluid via the outlet-line 50 into the space 46 formed between the pressing element 15 and the cavity 44 receiving the pressing element 15. Although not shown in the drawing, seals are provided around the walls of the pressing element 15 which cooperate with the walls of the chamber 44 to prevent undesired leakage of fluid between the pressing element and the walls 44. The pressure fluid supplied by the pump P into the space 46 has two effects. First of all it generates a pressure in the space 46 which presses the pressing element 15 upwardly, and thus produces the basic pressing force in the press gap. Secondly, part of the fluid supplied to the space 46 passes via the passage 28 into the trough 5 where it generates a pressure which supports the impermeable circulating band 4 at this position. In addition, part of the fluid supplied into the trough 5 escapes over the surface 36 of the pressing member 15, and thus results in a gradual reduction of pressure along the surface region 36 in the direction of band movement in the sense of the present teaching. The fluid passing over the surface 36 cannot return to the space 46 because of the need for seals between the pressing element 15 and the walls 44 of the chamber. It thus follows the surface of the pressing element 15 and sticks to the inner surface of the recirculating impermeable band 4 and is drawn over the perforated guide shield 52 provided at the right-hand end of the drawing of FIG. 10. Thus any pressure fluid which has reached the vertical wall 45 of the housing 44 in FIG. 10 passes over the tip of this wall and then over the perforated guide shield 52 where it runs back into the sump 40 provided within the housing 42. Any excess hydraulic fluid still adhering to the underside of the impermeable band 4 strikes an elongate scraper 54 and is removed by the latter so that it runs down the outside of the walls of the housing 42. Such fluid enters into a trap 56 formed by a gutter-like construction extending around the walls of the housing 42. Such hydraulic fluid then passes through apertures such as 58 into the space between the housing 44 and the chamber walls 42 and then again runs back into the supply 40 of hydraulic liquid present at the base of the housing 42.

In similar fashion to the embodiment of FIGS. 5, a portion 59 is provided at each side 32, 34 of the pressing element 15 and has the same general profile as the pressing element 15. The portions 59 may be slightly elevated relative to the surface 36 so as to clearly define a narrow gap between the base of the band 4 and the surface 36 in which the hydrodynamic oil film can be formed. The housing part 44 has end walls 60 adjacent the right-and-left-hand sides 32 and 34 of the pressing element 15 which have the same profile as the surface portions 59 of the pressing element 15. Only the left-hand sidewall 60 can be seen in FIG. 9 because of the broken-away illustration. Any hydraulic oil which crosses these profiled surfaces 59 and 60 can fall at the left-hand side of the pressing element shown by FIG. 9 onto a further portion 62 of the perforated guide metal structure so that excess oil drains through the apertures in this perforated portion 62 into the sump 40 within the housing 42. A corresponding perforated wall is provided at the right-hand side of the pressing element 15 but cannot be seen in the illustration of FIG. 9. In similar fashion to the gutter 56 a further gutter (not seen in FIG. 9) can be provided at each of the sidewalls 68 of the housing 42. Again only one such sidewall is shown in FIG. 9. Thus in this way, all lubricating fluid which might be lost from the normal pressure-loaded system is returned into the tank formed in the space 40 in the base of the housing 42, is available there for re-use and can now be picked up again by the pump P and forced via line 50 into the intermediate space 46 beneath the pressing member 15, thus completing the hydrodynamic circuit.

It is conceivable that the pump P need only be used to set the apparatus in operation, i.e. to start the circulation of the oil through the passageways 28 and the trough 5 into the space over the surface 36 of the pressing element 15 before it is returned to the sump 40. It is however also possible for the pump P to be stopped once the hydrodynamic pressure in the space between the moving band 4 and the surface 36 has been generated, this pressure being maintained by the moving band. Indeed it is even conceivable that a pump could be omitted altogether with the hydrodynamic film being generated solely by movement of the impermeable band 4.

Although the embodiment of FIGS. 9 and 10 has been described with reference to the use of a single pressing element 15 similar to that of FIG. 5, it will be appreciated that it would also be possible to use a plurality of pressing elements similar to those of FIG. 7 with walls 60 being provided either only at the extreme left-and-right-hand sides of the press gap or also between the individual pressing elements. It is also conceivable that the portions 59 have exactly the same profile as the surface 36 but that the walls 60 stand slightly above the surface 36 so as to define the hydrodynamic pressure gap between the band 4 and the surface 36.

Figure 11:
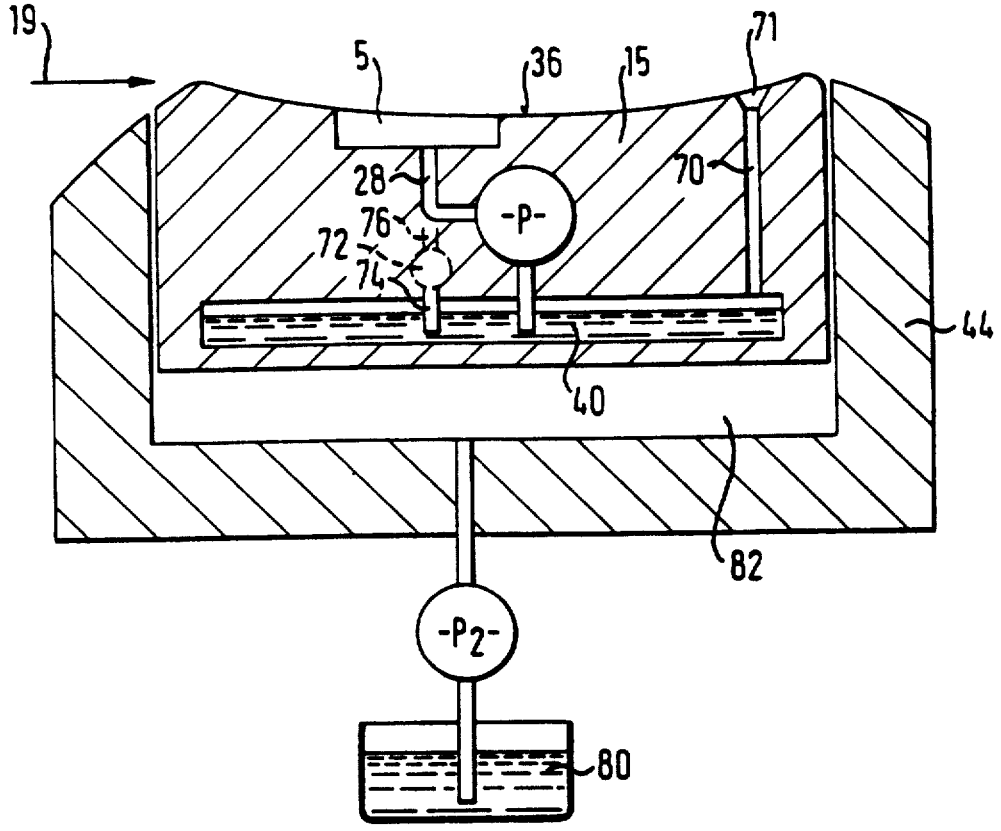
FIG. 11 shows a vertical cross-section through an embodiment similar to but different from the embodiment of FIGS. 9 and 10.

Finally, FIG. 11 shows an arrangement not dissimilar to that of FIGS. 9 and 10 but of somewhat simpler design. Here, the pump P is built into a cavity within the pressing element 15, and indeed draws hydraulic fluid from a supply or sump 40 which is likewise formed within a hollow cavity within the pressing element 15. The fluid supplied under pressure to the elongate trough 5 of the pressing element 15 passes under the influence of the applied pressure and/or under the influence of the movement of the impermeable band 4 over the surface 36 and is collected via suction tubes 70 provided at intervals along the length of the pressing element 15 (i.e. along the direction perpendicular to the direction of movement of the impermeable recirculating band 4) at the outlet end of the surface 36 of the pressing member. Thus, this hydraulic fluid is returned to the sump or supply 40 and is then recycled by the pump P through the gap 5. Again, this arrangement produces the desired varying hydrodynamic pressure in the gap between the pressing element 15 and the recirculating impermeable band 4. Reference numeral 71 denotes a continuous slot or channel across the width of the surface 36 to ensure all oil is collected by tubes 70. Again it is possible for the pump P to be disconnected after circulation has been set up, i.e. under the effect solely of the movement of the band 4. In this case, a valve 72, shown in broken lines, which is optionally provided is simultaneously opened with the shutting down of the pump P, so that the hydraulic fluid in the sump 40 can now pass through the tube 74, the valve 72 and a further tube 76 into the line 28 extending into the trough 5. A similar system could be adopted in the design of FIGS. 9 and 10.

Although the closed system described within the pressing element 15 maintains the requisite hydrodynamic pressure in the gap between the pressing element 15 and the recirculating impermeable band 4, this pressure does not of itself necessarily generate the full pressure required in the press gap. This full pressure can be generated by a second pump P2 which supplies pressure fluid from a sump 80 to a space 82 provided between the pressing element 15 and a guide housing 44 surrounding the pressing element 15. Again seals (not shown) are provided between the pressing element 15 and the walls 44 of the housing to prevent loss of pressure fluid from the space 82. Thus pump P2 generates a hydrostatic pressure in the space 82. If necessary, topping-up means (not shown) can be provided to the sump 40 or to the reservoir 80 to replenish fluid lost by eventual leakage.

It will be noted that common reference numerals have been used throughout the specification to designate parts having the same design or function. To the extend that certain reference numerals in certain figures have not been expressly described it will be understood that their description corresponds to that used for parts identified by the same reference numerals in the other figures.

What is claimed is:

1. Apparatus for dewatering a fibrous web passing therethrough in a direction of through movement, the apparatus comprising:

a first press surface formed by an impermeable band and a second press surface, said press surfaces forming an extended press zone for exerting dewatering pressure on the fibrous web;

heating means for heating at least one of said press surfaces;

a porous band for feeding through the extended press zone together with the fibrous web in order to take up water pressed out of the fibrous web;

pressing element means for pressing said impermeable band towards said second press surface, thereby exerting a pressure over a pressure active total length as seen in said direction of through movement, said pressing element means having an inlet end and a center, also as seen in said direction of through movement, and being arranged along said extended press zone such that a hydrodynamic pressure field is applicable between said pressing element means and said impermeable band by setting a lubricant in circulation; and one or more support pockets actuatable by a pressure medium, arranged on said pressing element means and open towards said impermeable band, wherein all the one or more support pockets are located essentially in the region between said inlet end and said center of the pressing element means.

2. Apparatus as set forth in claim 1, wherein said support pockets extend over approximately 10–18% of said pressure active total length, and in that said support pockets are so disposed that their center is displaced by approximately 21–32% of said pressure active total length from said center of the pressing element means towards said inlet end of the pressing element means.

3. Apparatus as set forth in claim 1, wherein the second press surface is formed by a counter roll.

4. Apparatus as set forth in claim 3, wherein the counter roll is heatable by the heating means.

5. Apparatus as set forth in claim 3, wherein the counter roll comprises an outer layer made from thermally conductive material and an inner layer made from thermally insulating material.

6. Apparatus as set forth in claim 5, wherein said heating means heats inductively and in that said outer layer of the counter roll is additionally ferromagnetic.

7. Apparatus for dewatering a fibrous web passing therethrough in a direction of through movement, the apparatus comprising:

a first press surface formed by an impermeable band and a second press surface formed by a counter roll, said press surfaces forming an extended press zone for exerting dewatering pressure on the fibrous web;

heating means for heating at least one of said press surfaces;

a porous band for feeding through the extended press zone together with the fibrous web in order to take up water pressed out of the fibrous web;

pressing element means for pressing said impermeable band towards said second press surface, thereby exerting a pressure over a pressure active total length, as seen in said direction of through movement, said pressing element means having an inlet end and a center, also as seen in said direction of through movement, and being arranged along said extended press zone such that a hydrodynamic pressure field is applicable between said pressing element means and said impermeable band by setting a lubricant in circulation;

one or more support pockets which are actuatable by a pressure medium and are arranged on said pressing element means and are open towards said impermeable band, wherein all the one or more support pockets are located essentially in the region between said inlet end and said center of the pressing element means; and a permeable flexible band located between the fibrous web and the porous band for pressing the fibrous web with a contact pressure against the counter roll in a wrapping region via an adjustable pressing means, said wrapping region extending partly around the counter roll beyond the pressing element means in said direction of through movement.

8. Apparatus as set forth in claim 7, wherein said support pockets extend over approximately 10–18% of said pressure active total length of the pressing element means, and in that said support pockets are so disposed that their center is displaced by approximately 21–32% of said pressure active total length from said center of the pressing element means towards said inlet end of the pressing element means.

9. Apparatus as set forth in claim 7, wherein the extent of the wrapping region and also of said contact pressure against the counter roll exerted by the permeable band are variable via the adjustable pressing means.

10. Apparatus as set forth in claim 7, wherein in the extended press zone and in the wrapping region, the permeable flexible band is contactable against at least one side of the fibrous web.

11. Apparatus as set forth in claim 7, including a device for heating or cooling the permeable band outside the extended press zone and wrapping region.

12. Apparatus as set forth in claim 7, wherein said heating means is for heating the counter roll.

13. Apparatus as set forth in claim 12, wherein the counter roll comprises an outer layer made from thermally conductive material and an inner layer made from thermally insulating material.

14. Apparatus as set forth in claim 13, wherein said heating means heats inductively and wherein said outer layer of the counter roll is additionally ferromagnetic.

* * * * *